US007386952B1

(12) United States Patent
Henretty

(10) Patent No.: US 7,386,952 B1
(45) Date of Patent: Jun. 17, 2008

(54) MODULAR GUN STOCK

(76) Inventor: Chris Henretty, 1060 Loma Dr., Hermosa Beach, CA (US) 90254-2914

( * ) Notice: Subject to any disclaimer, the term of this patent is extended or adjusted under 35 U.S.C. 154(b) by 0 days.

(21) Appl. No.: 11/623,611

(22) Filed: Jan. 16, 2007

(51) Int. Cl.
*F41C 23/00* (2006.01)

(52) U.S. Cl. ..... 42/71.01; 42/74

(58) Field of Classification Search ..... 42/71.01, 42/71.02, 72, 73, 74
See application file for complete search history.

(56) References Cited

U.S. PATENT DOCUMENTS

| | | | | | |
|---|---|---|---|---|---|
| 179,075 | A | * | 6/1876 | Smith | 42/73 |
| 490,129 | A | * | 1/1893 | Tredway | 42/74 |
| 724,273 | A | * | 3/1903 | Ermal | 42/74 |
| 935,163 | A | * | 9/1909 | Parker | 42/74 |
| 963,444 | A | * | 7/1910 | Johnson | 42/75.03 |
| 1,047,690 | A | * | 12/1912 | Oliver | 42/73 |
| 1,328,700 | A | * | 1/1920 | Wagoner | 42/74 |
| 1,334,467 | A | * | 3/1920 | Moller | 42/74 |
| 1,468,354 | A | * | 9/1923 | Caretto | 42/74 |
| 1,583,616 | A | * | 5/1926 | Smith | 42/75.03 |
| 1,651,299 | A | * | 11/1927 | Stansel | 42/73 |
| 1,847,777 | A | * | 3/1932 | Morgan | 42/73 |
| 1,964,649 | A | * | 6/1934 | Stetson | 42/74 |
| 2,187,640 | A | * | 1/1940 | Bost | 42/75.03 |
| 2,587,248 | A | * | 2/1952 | Turner | 42/73 |
| 2,669,051 | A | | 2/1954 | Cline | |
| 2,844,904 | A | | 7/1958 | Butler | |
| 2,956,343 | A | * | 10/1960 | Shaffer | 33/506 |
| 3,233,354 | A | * | 2/1966 | Ahearn | 42/74 |
| 3,371,442 | A | * | 3/1968 | Carlson | 42/74 |
| 3,707,797 | A | | 1/1973 | Ruth | |
| 4,012,859 | A | | 3/1977 | Johansson et al. | |
| 4,027,416 | A | * | 6/1977 | Alfonso Berbegal | 42/73 |
| 4,055,016 | A | * | 10/1977 | Katsenes | 42/71.01 |
| 4,769,937 | A | * | 9/1988 | Gregory et al. | 42/74 |
| 4,896,446 | A | * | 1/1990 | Gregory | 42/73 |
| 5,031,348 | A | * | 7/1991 | Carey | 42/74 |
| 5,235,764 | A | * | 8/1993 | Perazzi | 42/73 |
| 5,367,812 | A | | 11/1994 | Lautrec | |
| 5,711,102 | A | | 1/1998 | Plaster et al. | |
| 5,813,158 | A | * | 9/1998 | Campbell et al. | 42/75.03 |
| 6,684,549 | B2 | * | 2/2004 | Bragg | 42/74 |
| 6,839,998 | B1 | | 1/2005 | Armstrong | |
| 6,886,286 | B2 | * | 5/2005 | Dowding | 42/75.03 |
| 6,889,463 | B2 | * | 5/2005 | Orth | 42/75.03 |
| 7,104,000 | B2 | | 9/2006 | Orth | |
| 7,104,002 | B2 | * | 9/2006 | Rotundo | 42/73 |
| 7,124,529 | B1 | * | 10/2006 | Havelka, Jr. | 42/74 |
| 2005/0241205 | A1 | * | 11/2005 | Rotundo | 42/71.01 |
| 2006/0096148 | A1 | * | 5/2006 | Beretta | 42/74 |

* cited by examiner

*Primary Examiner*—Michael J. Carone
*Assistant Examiner*—Daniel J Troy
(74) *Attorney, Agent, or Firm*—Delevie Law, PLC

(57) ABSTRACT

A modular gun stock includes a forestock supporting the action and barrel, and a buttstock assembly removably secured to the forestock. The length of the buttstock assembly is selected to provide a desired length of pull, such that replacement of the buttstock assembly provides ready customization of the length of the stock for different shooters, or for different shooting situations. The buttstock assembly includes two projecting locating pins that are received in complementary bores defined in the forestock. A rubber insert, located in the tip of each locating pin, and a gasket disposed between the buttstock assembly and the forestock, are respectively slightly compressed as the buttstock assembly is secured by a threaded fastener to the forestock. The durometer of the rubber insert and material of the gasket are preferably selected to lessen felt recoil and damp vibration.

16 Claims, 2 Drawing Sheets

MODULAR GUN STOCK

FIELD OF THE INVENTION

The invention relates generally to gun stocks and, particularly, to gun stocks that can be readily modified to adapt the firearm to shooters requiring different lengths of pull, or other shooting requirements.

BACKGROUND OF THE INVENTION

Sporting guns, such as rifles and shotguns are provided with varied types of stocks to suit the requirements of different shooters and of different shooting situations, including different firing positions as when standing, seated, or prone, with such gun stocks often being made available in a variety of fixed sizes and shapes in order to customize the gun to a given shooter or a specific shooting situation. For example, dependent upon the stature and arm length of a person, a suitable gun stock will be longer or shorter from the vertical center of the trigger to the vertical center of the butt plate or recoil pad on the end of the stock, to thereby provide a desired "length of pull." Thus, multiple guns or replacement gun stocks are usually required to accommodate shooters of different stature and/or arm length, or to accommodate varied shooting situations.

What is needed, then, is a gun stock that is readily adaptable to different shooters and different shooting situations, thereby obviating the need for having more than one gun or several stocks available when accommodating multiple shooters or varied shooting situations.

SUMMARY OF THE INVENTION

A modular gun stock for use, for example, with a rifle or shotgun includes a forestock adapted to support the gun's action, wherein the forestock defines at least a portion of a grip disposed rearwardly of the action's trigger; and a buttstock assembly secured to the forestock as by a threaded fastener. The buttstock assembly includes at least two projecting locating pins that are received within complementary bores of the forestock to thereby align the buttstock assembly with the forestock. A rubber gasket disposed between the forestock and buttstock assembly seals the joint and improves felt recoil.

In accordance with an aspect of the invention, the nominal length and shape of the buttstock assembly is selected to provide a given shooter with a correct length of pull and any other requirements of the given shooter for a selected shooting situation. When the thus-outfitted firearm is thereafter to be used by another shooter, or by the same shooter in a different shooting situation requiring a different stock configuration, the buttstock assembly is removed from the forestock by loosening the fastener, whereupon a replacement buttstock assembly is easily joined with and secured to the forestock assembly. It will be appreciated that the configuration of the butt plate, recoil pad, cheek piece, and other features of the buttstock assembly can also differ as between several replaceable buttstock assemblies, thereby permitting the shooter to quickly customize those features by simply switching buttstock assemblies.

In accordance with another aspect of the invention, a rubber insert is respectively disposed within and projects from a counterbore defined in the end of each locating pin. The rubber inserts are sized, along with the relative length of the locating pins and the depth of the pin-receiving bores of the forestock, and the relative thickness of the gasket, such that the rubber inserts first engage the bottom of the pin-receiving bores of the forestock as the buttstock assembly is tightened to the forestock, before the gasket is slightly compressed. In this manner, both the rubber inserts and the gaskets are axially compressed as the buttstock assembly is joined to the forestock, to thereby improve recoil dampening. It will be appreciated that the invention contemplates the selection of different durometer materials for the rubber inserts and the gasket, to provide a desired recoil dampening for a given buttstock assembly.

In accordance with yet another aspect of the invention, if a small increase in length of pull is otherwise desired for a given combination of forestock and buttstock assembly, a rigid spacer can be inserted between the forestock and buttstock assembly (to one side of the gasket). When used with suitable replacement rubber inserts (having an increased length, for example, sufficient to ensure that the tip of each replacement rubber insert engages the bottom of the pin-receiving bore with the spacer installed), the length of pull can be slightly increased without significantly altering the recoil dampening effects of the gun stock. It will be appreciated that a second gasket may also be employed with the spacer, primarily to prevent moisture intrusion into the resulting joint.

From the foregoing, it will be appreciated that the invention advantageously facilitates the correct sizing of the stock for a given shooter or shooting situation, and particularly its length of pull, without otherwise affecting the gun's point of aim.

Other objects, features, and advantages of the invention will be readily appreciated upon a review of the subsequent description of the preferred embodiment and the appended claims, taken in conjunction with the accompanying Drawings.

DETAILED DESCRIPTION OF THE INVENTION

Figure 1:
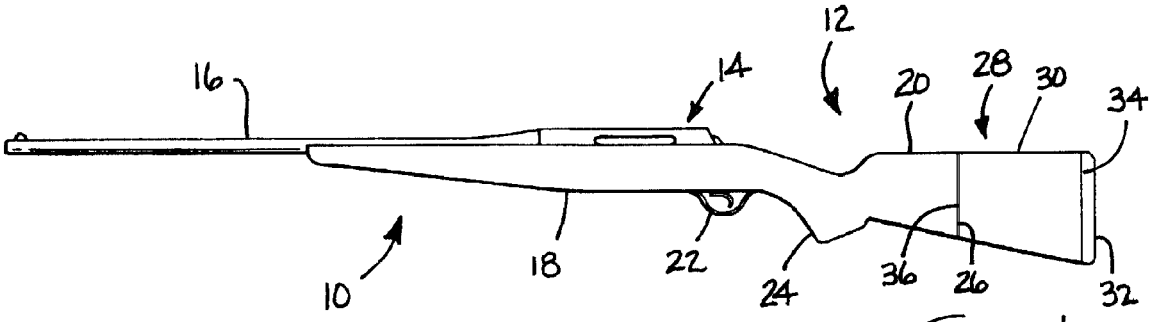
FIG. 1 is a side elevation of a rifle featuring a modular gun stock embodying aspects of the invention.
Figure 2:
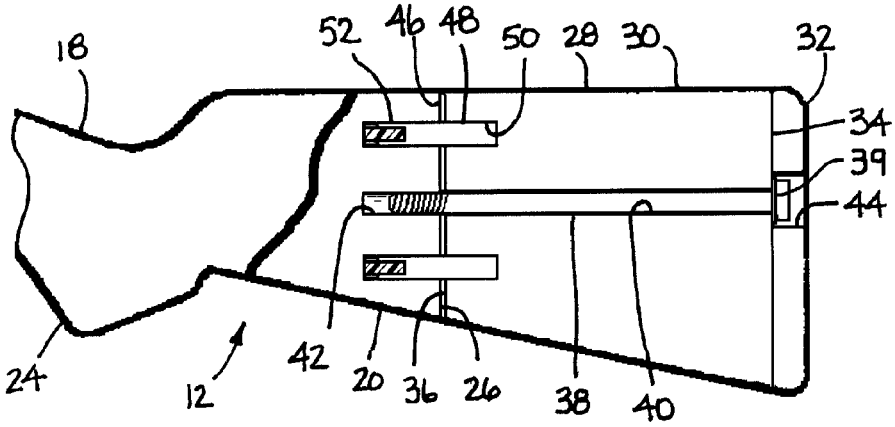
FIG. 2 is a partial side elevation of the modular gun stock shown in FIG. 1, partially broken away.

Referring to FIGS. 1 and 2, an exemplary rifle 10 incorporating a modified gun stock 12 in accordance with the invention includes an action 14 and a barrel 16, each supported by a forestock 18. The rear portion 20 of the forestock 18, generally behind of the action's trigger 22, defines a grip 24 and the forestock's rear face 26. A buttstock assembly 28 includes a buttstock 30 having a butt plate or recoil pad 32 secured to its rear end 34, and a front face 36 that is secured to the rear face 26 of the forestock 18. The forestock 18 and buttstock 30 are formed of any suitable material, including wood, laminate, or plastic.

While the invention contemplates securing the buttstock assembly 28 to the forestock 18 in any suitable manner, as seen in FIG. 2, in the exemplary rifle 10, the buttstock assembly 28 is secured to the forestock 18 with a threaded fastener 38 that extends through a complementary bore 40 in the buttstock 30 into a complementary threaded aperture 42 defined in the rear face 26 of the forestock 18. A lock washer or, preferably, a Belleville washer 39 is used to ensure that a desired tension is achieved on the tightened fastener 38.

Thus, by loosening the fastener 38, whose head is conveniently accessed via a suitable recess 44 defined in the buttstock assembly's recoil pad 32, a first buttstock assembly 28 can be quickly detached from the rear face 26 of the forestock 18, and a second buttstock assembly (not shown) featuring either a different nominal length (as measured from its front face to its recoil pad) and/or a different shape (for example, as to the butt plate/recoil pad 32, cheek piece, or other surface having a desired shape or contour) can be quickly secured in its place to the forestock 18. In this manner, the modular gun stock 12 of the invention advantageously allows a single rifle 10 to be readily customized for use by several different shooters, or for use by a single shooter in several different shooting situations, by simply detaching one buttstock assembly 28 and replacing it with another buttstock assembly 28, with the further advantage that the action 14 need never be removed from the forestock 18 when switching buttstock assemblies 28.

Referring again to FIGS. 1 and 2, while the invention contemplates any suitable configuration for the respective, complementary faces 26,36 of the forestock 18 and buttstock assembly 28, in the modular gun stock 12 of the exemplary rifle 10, the face 26 of the forestock 18 is generally planar and, further, is generally perpendicular to the nominal axis of the gun's barrel 16. A gasket 46 is disposed between the respective faces 26,36 of the forestock 18 and buttstock assembly 28. The gasket 46, which is preferably formed of a stiff-but-pliable, dense rubber, resists entrance of moisture into the resulting joint between the forestock 18 to the buttstock assembly 28 and aids in recoil dampening.

Figure 3:
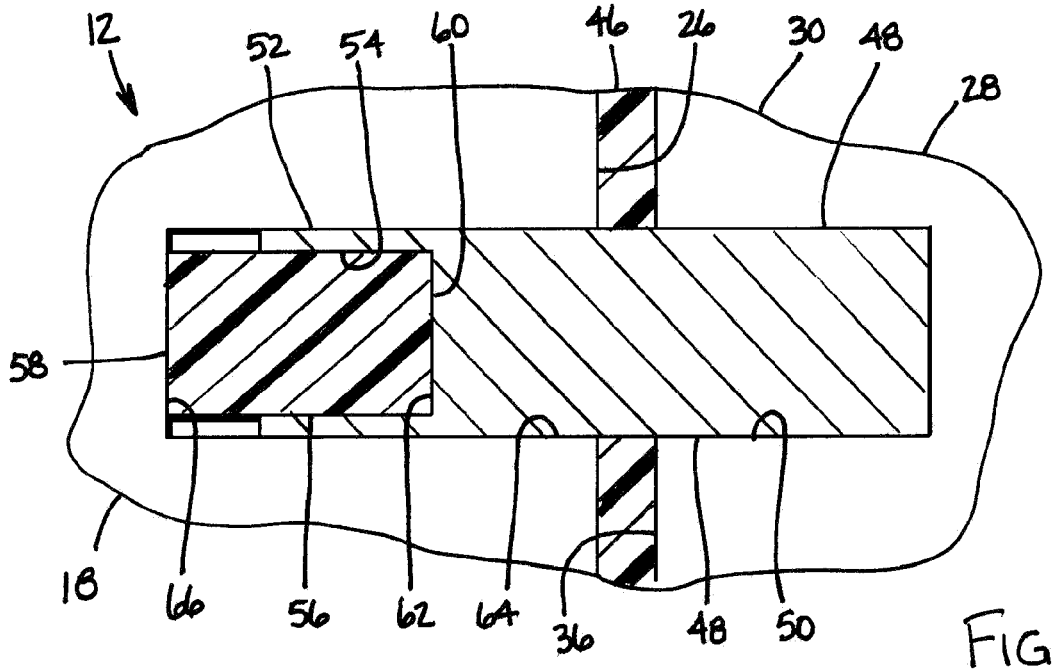
FIG. 3 is an enlarged view of the modular gun stock, within Circle 3 of FIG. 2.

In accordance with another aspect of the invention, and as best seen in FIGS. 2 and 3, to ensure a proper alignment between the forestock 18 and the buttstock assembly 28, a pair of locating pins 48 made, for example, of a hard polymer plastic or other suitable material such as aluminum or stainless steel, are seated in respective bores 50 defined in the front face 36 of the buttstock 30, such that a first end 52 of each pin 48 projects from the buttstock's front face 36. The first end 52 of each pin 48 also includes a counterbore 54. A generally-cylindrical rubber insert 56 is received in the counterbore 54 of each locating pin 48. The rubber insert 56 has a nominal length such that one end 58 of the rubber insert 56 projects a predetermined distance from the first end 52 of the pin 48 as the other end 60 of the rubber insert 56 abuts the bottom surface 62 of the counterbore 54.

The rear face 26 of the forestock 18 similarly includes a pair of bores 64, each being adapted to receive the first end 52 of a respective locating pin 48, such that the buttstock 30 is aligned with the forestock 18 as their respective faces 26,36 are drawn toward one another by the fastener 38. Depending upon the relative hardness of the material of the forestock 18, the pin-receiving bores 64 may be lined where necessary (not shown) to ensure that the pin-receiving bores 64 remain dimensionally stable and undistorted, notwithstanding the effects of moisture, temperature, material aging, and repeated locating pin insertions/withdrawals.

As best seen in the enlarged view of FIG. 3, the nominal depth of the pin-receiving bores 64 in the forestock 18 is slightly less than the sum of the thickness of the gasket 46 and the distance that the one end 58 of the rubber insert 56 projects from the front face 36 of the buttstock 30, such that each rubber insert 56 engages the bottom surface 66 of its respective pin-receiving bore 64 of the forestock 18 as the buttstock assembly 28 is tightened to the forestock 18, preferably before the gasket 46 is also slightly compressed. As also seen in FIG. 3, the nominal diameter of the rubber inserts 56 are preferably slightly less than the internal diameter of the pin-receiving bores 64, to allow extra space for a slight radial expansion of each rubber insert 56 as the rubber insert 56 is axially compressed.

Thus, upon tightening the fastener 38 to draw the respective faces 26,36 of the forestock 18 and buttstock 30 toward one another, both the rubber inserts 56 and the gasket 46 are resiliently compressed to thereby improve recoil dampening. It will be appreciated that the invention contemplates the selection of different durometer materials for the rubber inserts 56 and the gasket 46, and perhaps even for each individual rubber insert 56, to provide a desired recoil dampening for a given buttstock assembly 28.

Figure 4:
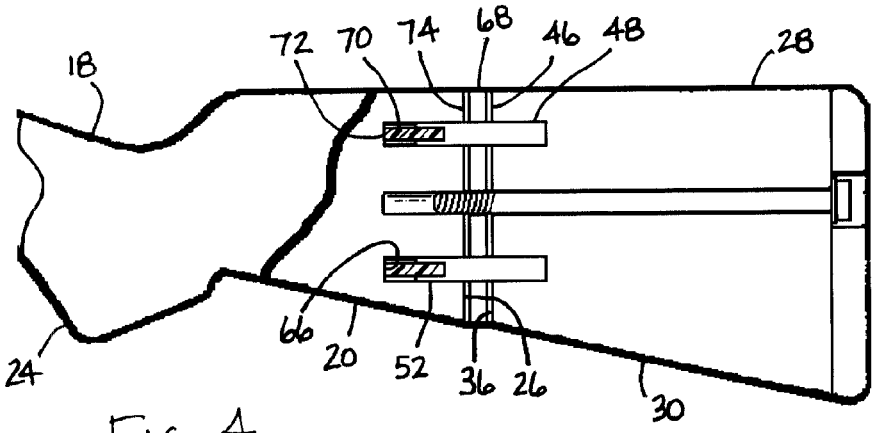
FIG. 4 is a second partial side elevation of the modular gun stock of FIG. 1, which has been further modified in that a rigid spacer installed between the forestock and the buttstock assembly provides a nominal increase in the rifle's length of pull without having to substitute a slightly-longer buttstock assembly.

FIG. 4 shows a further modification of the gun stock 12, wherein a rigid spacer 68 is inserted between the forestock 18 and buttstock assembly 28, to one side of the gasket 46, to provide a slight increase in the rifle's length of pull than is otherwise provided by the given buttstock assembly 28. As also seen in FIG. 4, when using the spacer 68, longer rubber inserts 70 are inserted into the first ends 52 of the locating pins 48, such that the projecting end 72 of each replacement rubber insert 70 still engages the bottom surface 66 of the pin-receiving bore 64 in the forestock 18 when the spacer 68 is installed. A second gasket 74 is also used to seal the resulting joint between the forestock 18 and the spacer 68, primarily to prevent moisture intrusion into the joint. It will be appreciated that the second gasket 74 can conveniently be permanently adhered to the face of the spacer 68, to facilitate its retention upon disassembly of the modular gun stock 12. Preferably, the relative durometer of the two gaskets 46,74 and the replacement rubber inserts are all selected to provide the rifle 10 with the desired recoil dampening.

Figure 5:
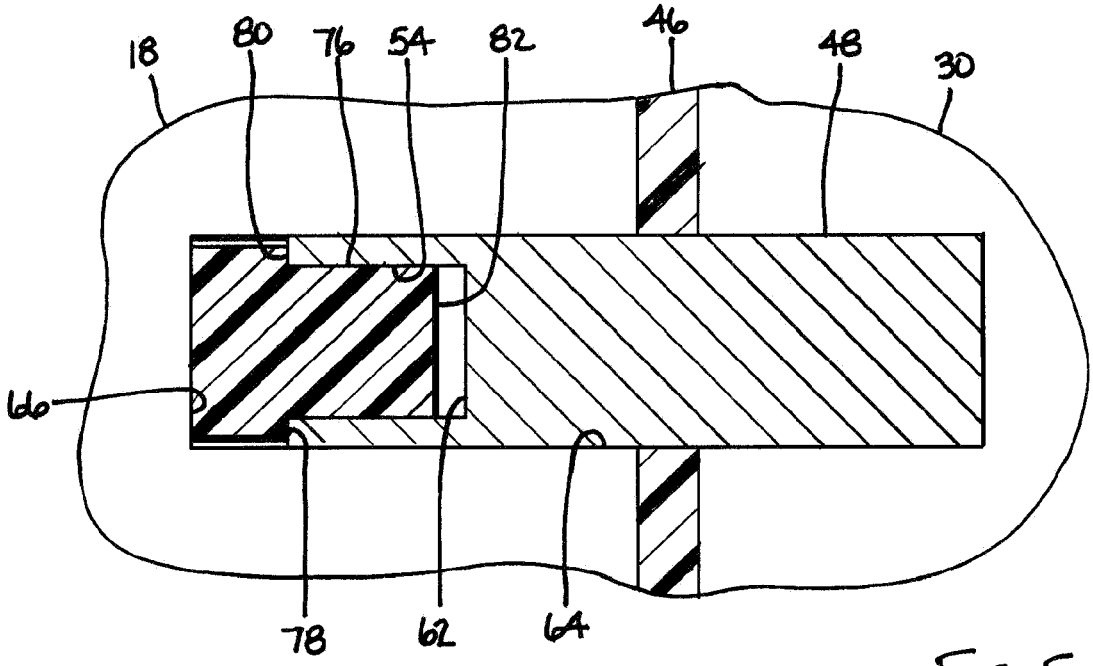
FIG. 5 is an enlarged view of an alternate modular gun stock, similar to that of FIG. 4, featuring modified rubber inserts within the ends of the buttstock assembly's locating pins.

FIG. 5 shows an alternative rubber insert 76 that may be used in the modular gun stock 12. Specifically, each alternative rubber insert 76 includes a shoulder 78 that abuts the tip 80 of its respective locating pin 48, with the further advantage that the inserted end 82 of the alternative rubber insert 76 need not engage the bottom 62 of the pin's counterbore 54. In this manner, the use of the alternative rubber inserts 76 obviates the need to carefully control the depth and bottom surface 62 of each counterbore 54 to thereby lower the relative cost of each locating pin 48, while further limiting the axial compression of each alternative rubber insert 76 to its exposed, projecting length.

While the above description constitutes the preferred embodiment, it will be appreciated that the invention is susceptible to modification, variation and change without departing from the proper scope and fair meaning of the subjoined claims. For example, while the foregoing discloses a rifle having a modular stock in accordance with several aspects of the invention, it will be appreciated that the invention is equally well suited to shotguns and other firearms wherein a degree of flexibility over the length and configuration of the stock is desired without having to replace the stock in its entirety.

What is claimed is:

1. A modular gun stock comprising:

a forestock having a rear face and at least two generally-cylindrical bores defined in the rear face, each bore having a bottom surface; and a buttstock assembly including a buttstock defining a front face, at least two locating pins having a first end projecting from the front face and adapted to be received within the respective bores of the forestock when the rear face of the forestock is drawn toward front face of the buttstock assembly, wherein the first end of each pin includes a counterbore, a rubber insert disposed within the counterbore of each pin such that an end of the rubber insert projects from the first end of the pin, and a fastener drawing the rear face of the forestock toward the front face of the buttstock assembly, the rubber inserts being resiliently compressed against the respective bottom surfaces of the bores.

2. The modular gun stock of claim 1, including a first gasket disposed between the rear face of the forestock and the front face of the buttstock.

3. The modular gun stock of claim 2, wherein the first gasket is resiliently compressed to a lesser degree than the rubber inserts.

4. The modular gun stock of claim 2, wherein the first gasket is formed of a dense rubber.

5. The modular gun stock of claim 2, further including a spacer disposed between rear face of the forestock and the front face of the buttstock.

6. The modular gun stock of claim 5, wherein the first gasket is disposed between the front face of the buttstock and the spacer, and further including a second gasket disposed between the rear face of the forestock and the spacer.

7. The modular gun stock of claim 1, wherein the bores have a first diameter, and wherein the projecting end of each rubber insert is generally cylindrical with a second diameter slightly less than the first diameter.

8. The modular gun stock of claim 1, wherein the rear face of the forestock is generally planar.

9. A modular gun stock comprising:

a forestock defining at least a portion of a grip behind an action, and a rear face disposed behind the grip, the forestock further including a threaded bore and at least two generally smooth, cylindrical bores defined in the rear face, each smooth bore having a bottom surface;

a buttstock defining a front face and an butt plate;

at least two locating pins having a first end projecting from the front face and adapted to be received within the respective smooth bores of the forestock when the rear face of the forestock is drawn toward front face of the buttstock;

a fastener on the buttstock engaging the threaded bore of the forestock to thereby draw the rear face of the forestock toward the front face of the buttstock; and a cylindrical rubber insert within each of the smooth bores of the forestock, each rubber insert being axially compressed between the bottom surface of the smooth bore and the first end of the locating pin.

10. The modular gun stock of claim 9, wherein a projecting end of each pin includes a counterbore, and wherein the rubber insert is partially disposed within the counterbore of each pin such that an end of the rubber insert projects from the end of the pin.

11. The modular gun stock of claim 9, further including a first rubber gasket disposed between the rear face of the forestock and the front face of the buttstock assembly, the first gasket being resiliently compressed to a lesser degree than the rubber inserts.

12. The modular gun stock of claim 11, wherein the first gasket is formed of a dense rubber.

13. The modular gun stock of claim 11, further including a spacer disposed between rear face of the forestock and the front face of the buttstock.

14. The modular gun stock of claim 13, wherein the first gasket is disposed between the front face of the buttstock and the spacer, and further including a second gasket disposed between the rear face of the forestock and the spacer.

15. The modular gun stock of claim 9, wherein each smooth bore has a first diameter, and wherein the each rubber insert has a second diameter slightly less than the first diameter.

16. The modular gun stock of claim 9, wherein the rear face of the forestock is generally planar.

* * * * *